US005415243A

United States Patent [19]

Lyon et al.

[11] Patent Number: 5,415,243

[45] Date of Patent: May 16, 1995

[54] ROCK BIT BOREHOLE BACK REAMING METHOD

[75] Inventors: Richard C. Lyon, Denver, Colo.; William M. Conn, Ponca City, Okla.

[73] Assignee: Smith International, Inc., Houston, Tex.

[21] Appl. No.: 185,643

[22] Filed: Jan. 24, 1994

[51] Int. Cl.[6] ..... E21B 10/16; E21B 10/52

[52] U.S. Cl. ..... 175/331; 76/108.2; 175/401; 175/408

[58] Field of Search ..... 175/331, 374, 401, 426, 175/408; 76/108.2, 108.4

[56] References Cited

U.S. PATENT DOCUMENTS

| | | | |
|---|---|---|---|
| 1,637,594 | 8/1927 | Stewart | 175/401 X |
| 1,816,568 | 7/1931 | Carlson | 175/401 X |
| 3,389,761 | 6/1968 | Ott | 175/426 X |
| 4,140,189 | 2/1979 | Garner | 175/374 X |
| 4,512,425 | 4/1985 | Brock | 175/408 X |
| 4,811,801 | 3/1989 | Salesky et al. | 175/374 X |

*Primary Examiner*—David J. Bagnell
*Attorney, Agent, or Firm*—Robert G. Upton

[57] ABSTRACT

A method to back ream a borehole drilled with a roller cone drill bit is taught. Protruding hard metal cutting inserts are affixed on the upper outside diameter tapered shoulder of each of the bit legs. If the borehole closes to a smaller diameter than the bit gage diameter or loose rock rubble packs around the upper portion of the bit, the protruding cutting inserts fixed on the upper leg tapered shoulder portion back ream the borehole by lifting and rotating the bit.

5 Claims, 1 Drawing Sheet

ROCK BIT BOREHOLE BACK REAMING METHOD

FIELD OF THE INVENTION

This invention is directed to the art of drilling rock for heavy construction, oil or gas wells, water wells, mineral exploration holes or blast holes by rotary methods using compressed gas or other fluids, such as drilling muds, to cool the drill bit and to clear the borehole of rock cuttings.

More specifically, the invention relates to very hard wear resistant inserts fitted on the upper tapered outer shoulder of the rock bit legs adjacent the threaded connection of the bit. These hard inserts have extension above the leg surface to enable them to drill upwards to ream an undergage hole or mill up rock rubble accumulated around the bit.

Very often while drilling using, for example, a compressed gas, such as air, to transport the drilled rock cuttings out of the borehole, the density of the gas in the borehole is insufficient to maintain the integrity of the hole. Tectonic forces tend to collapse the hole making it much smaller in diameter than the bit gage diameter or filling the hole with loose rock rubble around the drill bit and the lower drill string. This essentially stops the drilling process making it necessary to pull the drill string and bit out of the hole. Under these conditions, it is generally necessary to rotate the drill string and bit as they are lifted upwards to try to "back-ream" the closed in hole and crush the rock detritus in the well bore annulus. This "back-reaming" operation causes very severe abrasion and erosion of the outer surfaces of the bit legs. This also causes the gage and heel row inserts of the rotary cones on the bit to "back-ream". This results in severe degradation of the rotary cone bearings because of the in-thrust produced by the reaming. Lost legs and/or cones of the bit may be the result of the back-reaming operation.

BACKGROUND OF THE INVENTION

A multiplicity of flat faced or flush type tungsten carbide inserts positioned in the shirt-tail and the lower outer surfaces of the bit legs are currently being used in the industry to try to alleviate the erosion and abrasion of the bit legs. Because the hard inserts are flat faced and have no protrusion from the surface in which they are mounted, very little actual "back-reaming" of an undergage well bore or drilling up of the rock rubble in the annulus is accomplished. Some protection of the lower leg surfaces from severe abrasion is gained by using these inserts. Because they do no reaming, the flush type inserts in the lower leg surfaces do little to alleviate the in-thrust of the rotary cones, therefore bearing degradation remains a severe problem.

SUMMARY OF THE INVENTION

It is an object of this invention to prevent severe abrasive and erosive damage to the upper leg structures of a drill bit. This damage is normally incurred while attempting to "back-ream" an undergage borehole or break up and disperse accumulated rock rubble in the borehole annulus around the bit.

It is also an object of the present invention to minimize the degradation of the beatings of the rock bit rotary cones that is caused by the in-thrust of the cones while back-reaming an undergage borehole or trying to mill up loose rock rubble accumulated around the drill bit as the bit is removed from a borehole.

A rotary cone rock bit for drilling boreholes in a earthen formation consisting of a bit body that forms a first threaded pin end and a second cutter end. The body further forms at least one leg, a shirttail lower end of the leg supporting a cantilevered bearing therefrom. The bearing retains the rotary cone thereon. The leg further forms a tapered shoulder positioned between the threaded pin end and the cutting end of the bit. The shoulder being proximate a base end of the threaded pin.

One or more protruding cutting elements such as, for example, tungsten carbide inserts are strategically positioned in said tapered shoulder. The cutting elements serve to clear formation rubble accumulated around the upper portion of hte rock bit and to back-ream the borehole as the bit is rotatably removed from the borehole.

The lower outer surfaces of the legs of a bit, generally referred to as the shirt tail, has a slightly smaller radius of curvature than the borehole cut by the gage teeth or inserts of the bit. This radius of curvature remains generally constant upwards to the O.D. taper of the legs which reduces the leg diameter to the bit thread shoulder diameter. The curved leg surface is fitted with a multiplicity of flush set flat top tungsten carbide inserts to minimize abrasion and wear of this surface. The tapered shoulder surface has a multiplicity of protruding inserts strategically affixed thereto. These inserts have sufficient protrusion above the tapered steel surface to aggressively "up-ream" the loose rock rubble and also to enlarge an undersize borehole. The protruding inserts may be dome shape, for example, but may be conical or chisel shaped depending upon the rock formations being drilled. These inserts are generally made from cobalt cemented tungsten carbide, but for very abrasive rocks may be diamond coated tungsten carbide as described in U.S. Pat. No. 4,811,801, which is assigned to the same assignee as the present invention and is included herewith in its entirety for reference.

An advantage of this invention is the protruding hard material inserts on the tapered shoulder of the bit legs of a roller cone bit using a compressed gas to facilitate hole cleaning can effectively "up-ream" the borehole to disperse or crush rock formation rubble or debris permitting the bit to be withdrawn from the borehole without undue abrasive/impact damage to the bit.

Another advantage of this invention is that the protruding hard material inserts on the tapered shoulder of the bit can effectively "up-ream" an undergage borehole whereby the inward reaming reaction forces are not imposed on the roller cone bearings of the bit, therefore essentially precluding failure of the bearings caused by in-thrust forces.

Yet another advantage of this invention is the use of the up-reaming feature in a rock bit normally associated with deep hole drilling utilizing drilling muds to remove debris and to cool and clean the bit.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
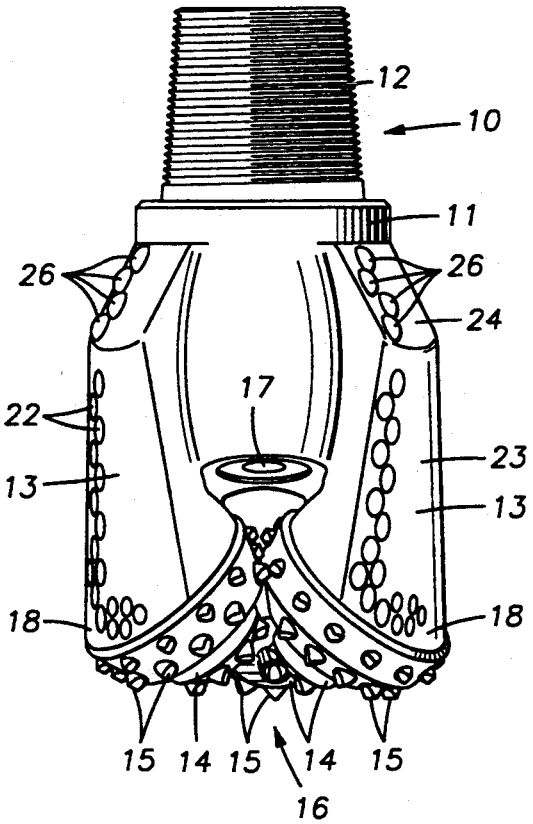
FIG. 1 is an isometric view of a roller cutter drill bit of the present invention.

FIG. 1 illustrates a typical rotary cone rock bit, generally designated as 10, which consists of bit body 11, pin end 12 and a cutting end generally designated as 16. The cutting end 16 comprises rotatable cutter cones 14 that are attached to a leg portion 13 near a shirttail 18. Each of the cones 14 has, for example, a multiplicity of cutter inserts 15 retained by the cone 14. Drilling fluid, such as "mud", water or compressed gas directed into a plenum chamber (not shown) formed by bit body 11 through pin end 12. The fluid is then directed from the chamber out nozzles 17 to cool the bit 10 and transport the drilled cuttings out of the borehole.

Figure 2:
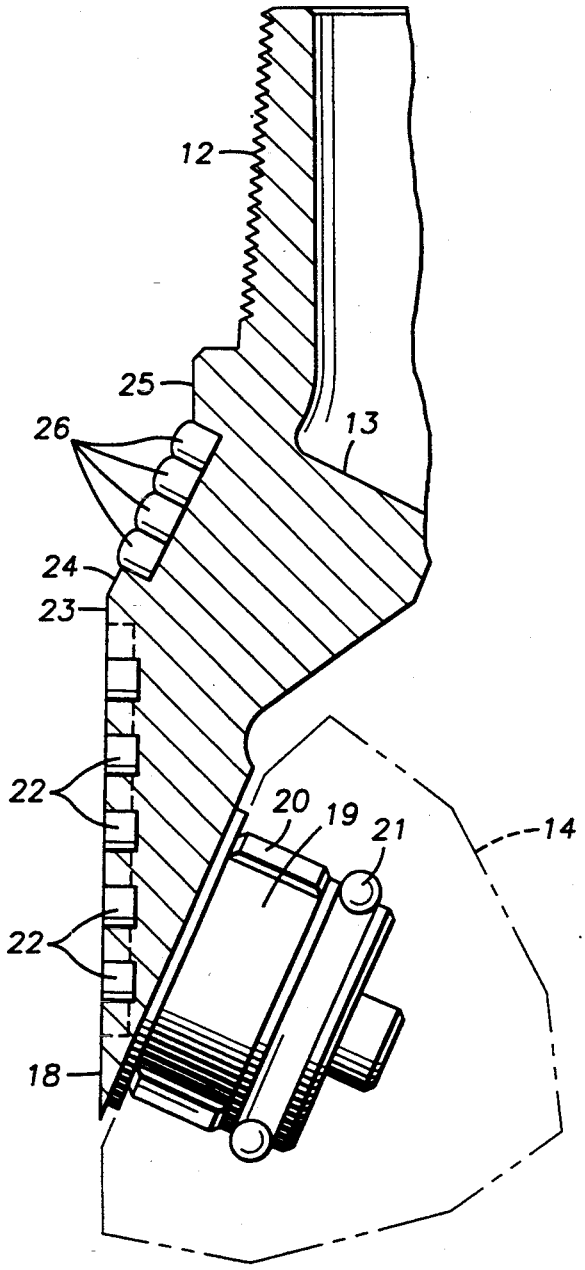
FIG. 2 is a partial cross section of a bit leg with an affixed roller cone (in phantom). Leg wear limiting carbide inserts are shown affixed in the leg outer surfaces and back-reaming inserts are illustrated affixed in the tapered surface above the vertical leg surface.

Turning now to FIG. 2, a leg of the bit 10, defines a journal cantilevered from the shirttail end 18 with the cone 14 rotatably mounted, for example, by roller beating 20 and ball bearing 21. The outer vertical surface 23 of the leg 13 is protected from excessive abrasive and erosive wear by the flat top tungsten carbide inserts 22 that are set flush with the outer leg surface 23. These flat faced inserts 22 do not do any significant reaming of the borehole. Inserts 26 protruding from the tapered shoulder 24 engage and enlarge the well bore during a back-reaming operation. Inserts 26 also engage and crush the loose rock rubble that accumulates in the well bore annulus above the vertical leg surface 23. Inserts 26 are illustrated as round top or dome shaped in the preferred embodiment, but may be chisel or conical shaped depending on the particular formation being drilled.

Figure 3:
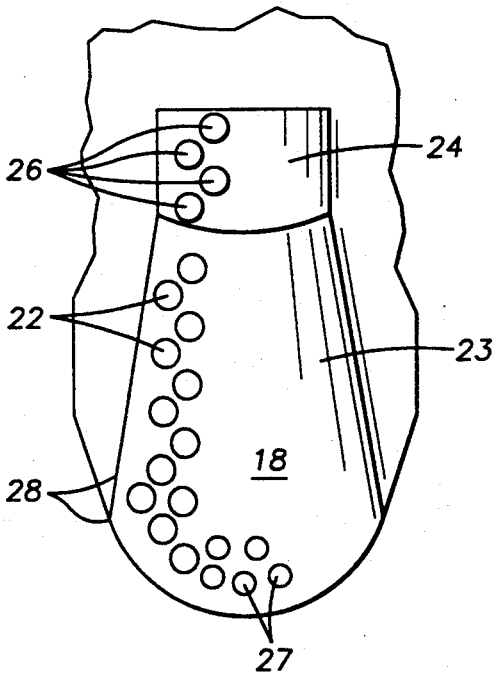
FIG. 3 is a view normal to FIG. 2 illustrating the carbide insert placement on the outer leg surfaces.

FIG. 3 illustrates the flat top carbide inserts 22 affixed in the leading portion of the vertical leg surface 23. For severe service, the complete surface 23 may have inserts 22 affixed thereto. Close set small flat top inserts 27 are affixed in the shirttail surface 18 to protect this very vulnerable area of the bit leg 13. More inserts may be used on this shirttail surface 18 for very severe drilling conditions. Alternatively, the leading edge 28 and shirttail portion 18 of leg 13 may be hardfaced with suitable hardfacing material (not shown). The back reaming inserts 26 are shown as two rows on the leading side of the tapered surface 24, but for extremely harsh conditions, additional inserts may be used on this surface 24 as deemed necessary.

Figure 4:
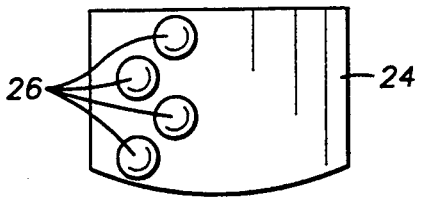
FIG. 4 is a view of the outer leg tapered surface normal to FIG. 2. The back reaming inserts placement is shown.

FIG. 4, being a view normal to the leg surface 24 of FIG. 2, indicates a minimal number of extended inserts 26 necessary to back ream formations of average hardness and strength. More inserts 26 may be added to this surface 24 as the rock strength and hardness increase.

It should be known that the preferred embodiment of the present invention is a tungsten carbide insert type drill bit, but a milled-tooth type drill bit fitted with the back-ream feature described above can also be used to good advantage under certain drilling conditions.

It should also be understood that the preferred type of bit for use with the present invention has a non-sealed bearing system, but a bit with sealed bearings may be used beneficially for certain drilling conditions.

It should be noted that when drilling certain very soft broken rock formations, steel cutting teeth (not shown) may be formed on the tapered shoulder 24 to facilitate rapid back-reaming of the formation detritus accumulated around the upper part of the rock bit body 11.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A rotary cone rock bit for drilling boreholes in an earthen formation comprising:

a bit body forming a first threaded pin end and a second cutter end, said body further forming at least one leg thereby, said leg having a bearing cantilevered from a downwardly extending shirttail portion of the leg thereof, said bearing supporting said rotary cone disposed thereon, said leg further forming a tapered shoulder portion between said first pin end and said shirttail portion, said tapered shoulder portion being positioned proximate a base portion of said first threaded pin end, said tapered shoulder portion having protruding therefrom one or more strategically positioned hard metal insert type cutting elements, said cutting elements serve to clear formation rubble accumulated around the upper portion of said rock bit and to back-ream said borehole as the bit is rotatably removed from the borehole.

2. The invention as set forth in claim 1 wherein said rotary cone rock bit is a three cone rock bit.

3. The invention as set forth in claim 1 wherein said one ore more strategically positioned hard metal insert type cutting elements protruding from said shoulder are tungsten carbide inserts.

4. The invention as set forth in claim 3 wherein said hard metal insert type cutting elements are diamond coated tungsten carbide inserts.

5. A method of breaking up and dispersing accumulated formation rubble adjacent an upper surface of a rotary cone rock bit and a method of back-reaming a borehole formed in an earthen formation as the rock bit is rotatably removed from said borehole comprising the steps of:

forming a tapered shoulder on a body of said rotary cone rock bit between a threaded pin end and a cutting end of said rock bit, forming one or more strategically placed insert retaining apertures in said tapered shoulder, securing one or more hard metal insert type cutting elements within said apertures formed in said tapered shoulder, a portion of said insert cutting elements protrude from said tapered shoulder, said protruding hard metal insert type cutting elements serve to engage and disperse said accumulated formation rubble and to back-ream said borehole as said rock bit is rotatably removed from said borehole.

* * * * *